US011446534B2

(12) United States Patent
Knox

(10) Patent No.: US 11,446,534 B2
(45) Date of Patent: Sep. 20, 2022

(54) PORTABLE COLLAPSIBLE FULL BODY STRENGTH FITNESS SYSTEM

(71) Applicant: Phillip Knox, Stone Mountain, GA (US)

(72) Inventor: Phillip Knox, Stone Mountain, GA (US)

( * ) Notice: Subject to any disclaimer, the term of this patent is extended or adjusted under 35 U.S.C. 154(b) by 0 days.

(21) Appl. No.: 16/829,065

(22) Filed: Mar. 25, 2020

(65) Prior Publication Data

US 2020/0306575 A1 Oct. 1, 2020

Related U.S. Application Data

(60) Provisional application No. 62/824,079, filed on Mar. 26, 2019.

(51) Int. Cl.

| | |
|---|---|
| ***A63B 21/02*** | (2006.01) |
| ***A63B 21/00*** | (2006.01) |
| ***A63B 23/12*** | (2006.01) |
| ***A63B 71/00*** | (2006.01) |
| ***A63B 21/078*** | (2006.01) |

(52) U.S. Cl.

CPC ..... *A63B 21/025* (2013.01); *A63B 21/078* (2013.01); *A63B 21/153* (2013.01); *A63B 21/154* (2013.01); *A63B 21/4029* (2015.10); *A63B 23/1281* (2013.01); *A63B 71/0036* (2013.01); *A63B 2210/50* (2013.01); *A63B 2225/09* (2013.01); *A63B 2225/093* (2013.01); *A63B 2225/10* (2013.01)

(58) Field of Classification Search

CPC . A63B 21/025; A63B 21/4029; A63B 21/078; A63B 21/153; A63B 21/154; A63B 21/4034; A63B 23/1281; A63B 2225/09; A63B 2225/10; A63B 2225/095; A63B 2210/50; A63B 2208/0204; A63B 2208/0233

See application file for complete search history.

(56) References Cited

U.S. PATENT DOCUMENTS 4,135,714 A * 1/1979 Hughes ..... A63B 69/36212 482/127
4,369,966 A * 1/1983 Silberman ..... A63B 21/154 482/104
4,483,330 A * 11/1984 Jacobsen ..... A63B 21/015 242/378.4
6,123,649 A * 9/2000 Lee ..... A63B 21/153 482/51

(Continued)

*Primary Examiner* — Garrett K Atkinson
*Assistant Examiner* — Kathleen M Fisk
(74) *Attorney, Agent, or Firm* — Charlena Thorpe, Esq.; Incorporating Innovation LLC

(57) ABSTRACT

The present invention relates to a fitness equipment system for providing a substantially constant force through a range of motion and includes at least one constant force resistance component. The object of the present invention is to build a lightweight, easily movable and transportable fitness equipment system. The present invention uses the constant force released from the resistance components instead of the gravitational force from weights used in traditional fitness systems. Finally, the present invention can be used by personal trainers, physical therapist, field personnel, with no access to traditional facilities or weightlifting equipment or facilities.

13 Claims, 14 Drawing Sheets

(56) References Cited

U.S. PATENT DOCUMENTS

| | | | | |
|---|---|---|---|---|
| 6,168,554 | B1 * | 1/2001 | Berg | A63B 22/0076 482/138 |
| 7,537,552 | B2 * | 5/2009 | Dalebout | A63B 21/00072 482/121 |
| 7,815,552 | B2 * | 10/2010 | Dibble | A63B 21/4043 482/92 |
| 2002/0025891 | A1 * | 2/2002 | CoIosky, Jr. | A63B 21/0455 482/127 |
| 2002/0077230 | A1 * | 6/2002 | Lull | A63B 21/4029 482/142 |
| 2005/0277523 | A1 * | 12/2005 | Harbaugh | A63B 21/4029 482/92 |

* cited by examiner

PORTABLE COLLAPSIBLE FULL BODY STRENGTH FITNESS SYSTEM

CROSS-REFERENCE TO RELATED APPLICATIONS

For purposes of the USPTO extra-statutory requirements, the present application constitutes a nonprovisional patent application of U.S. provisional patent application Ser. No. 62/824,079, entitled CONSTANT FORCE WORKOUT APPARATUS, naming PHILLIP KNOX as inventor, filed Mar. 26, 2019.

FIELD OF THE INVENTION

The present invention generally relates to fitness and exercise system. More specifically the present invention is an apparatus capable of providing the user with a full body workout that relies on constant force springs to provide mechanical resistance.

BACKGROUND OF THE INVENTION

Physical fitness can determine the quality of human life and physical longevity. People often do workout for strength training, physical comfort, athleticism, and other reasons. Physical activity is crucial to maintaining a healthy and balanced lifestyle. Workouts can be specifically tailored to an individual's goal. Each exercise is designed to work a select group of muscles, while other plans offer a more comprehensive coverage. Ensuring these exercises are performed correctly is essential to the health of the user. Appropriate equipment should be practiced at all times, to ensure the user is not hurt while the workout is performed. Various equipment has been developed to assist users with workouts. Some people have lifestyles where their life is centered around traveling for extended periods of time, as a result they are not able to have access to a fully equipped gym at all times. Portable workout equipment may be laborious to utilize, and it does not always provide the results claimed by the manufacturer. Furthermore, most traditional workout equipment relies on weights and are not easily portable.

These and many other problems have been long identified. Different solutions to the problems have been tried. However there exists no comprehensive solution to all the above problems.

Therefore, the objects of the invention overcome the limitations and drawbacks from the prior art. To achieve above and other objects, the present invention anticipates a new and entirely different system that resolves the limitations and drawbacks. The present invention provides a lightweight full body workout system capable of producing consistently high amounts of mechanical force.

Another object of the present invention is to use constant force into the system assembly, further providing a method of customization for the user without the need of additional weights or traditional dumbbells. As a result, the present invention is versatile and allows for a complete body workout in the gym, or at home and provides a variety of resistance from very low resistance to very high resistance.

Further object of the present invention is to provide a portable and transportable full body fitness system using a dedicated carrying bag. Considering the unique portability and lightweight features, the provided fitness system can also be used in the outdoor environments such as park and beach.

Yet another object of the present invention is to develop a full body fitness system that has the potential to be used by beginners as wells advanced users such as personal trainers, physical therapist, field personnel, with no access to traditional facilities or weightlifting equipment or facilities.

SUMMARY OF THE INVENTION

The present invention discloses a full body strength fitness system with an integrated force generating mechanism assisting the user by providing resistance during various types of exercises. In comparison with the traditional fitness systems that works on conventional system of using weights and gravitational energy to generate the necessary resistance for an effective workout, the present invention relies on constant force produced by using constant force springs. The difficulty levels may be adjusted depending on the skill and physical condition of the person, as such, variations may be done to increase the difficulty level depending on preference. The present invention aims to provide an effective full body workout in a compact embodiment.

In one embodiment, the present invention uses a plurality of resistance elements such as constant force springs into the system assembly, further providing a method of customization for the user without the need of additional weights or traditional dumbbells. As a result, the present invention is versatile and allows for a complete body workout in the gym, or at home and provides a variety of resistance from very low resistance to very high resistance.

In another embodiment, the resistance elements of the present invention functions by using the constant force produced as a result of applying a force to deform at least one resistant element. Each of the plurality of resistance elements may be a constant force spring, and the applied force may coil or uncoil the springs.

In another embodiment, the present invention provides a portable and transportable full body fitness system using a dedicated carrying bag. Considering the unique portability and lightweight features, the provided fitness system can also be used in the outdoor environments such as park and beach.

In another embodiment, the present invention provides a full body fitness system that has the potential to be used by beginners as wells advanced users such as personal trainers, physical therapist, field personnel, with no access to traditional facilities or weightlifting equipment or facilities.

These and further objects, features, and advantages of the present apparatus will become apparent from the following detailed description, wherein reference is made to the figures in the accompanying drawings.

BRIEF DESCRIPTION OF THE DRAWINGS

The prior and other objects of this invention, the various features thereof, as well as the invention itself, may be more fully understood from the following description, when read together with the accompanying drawings in which.

DETAILED DESCRIPTION OF THE INVENTION

Figure 1:
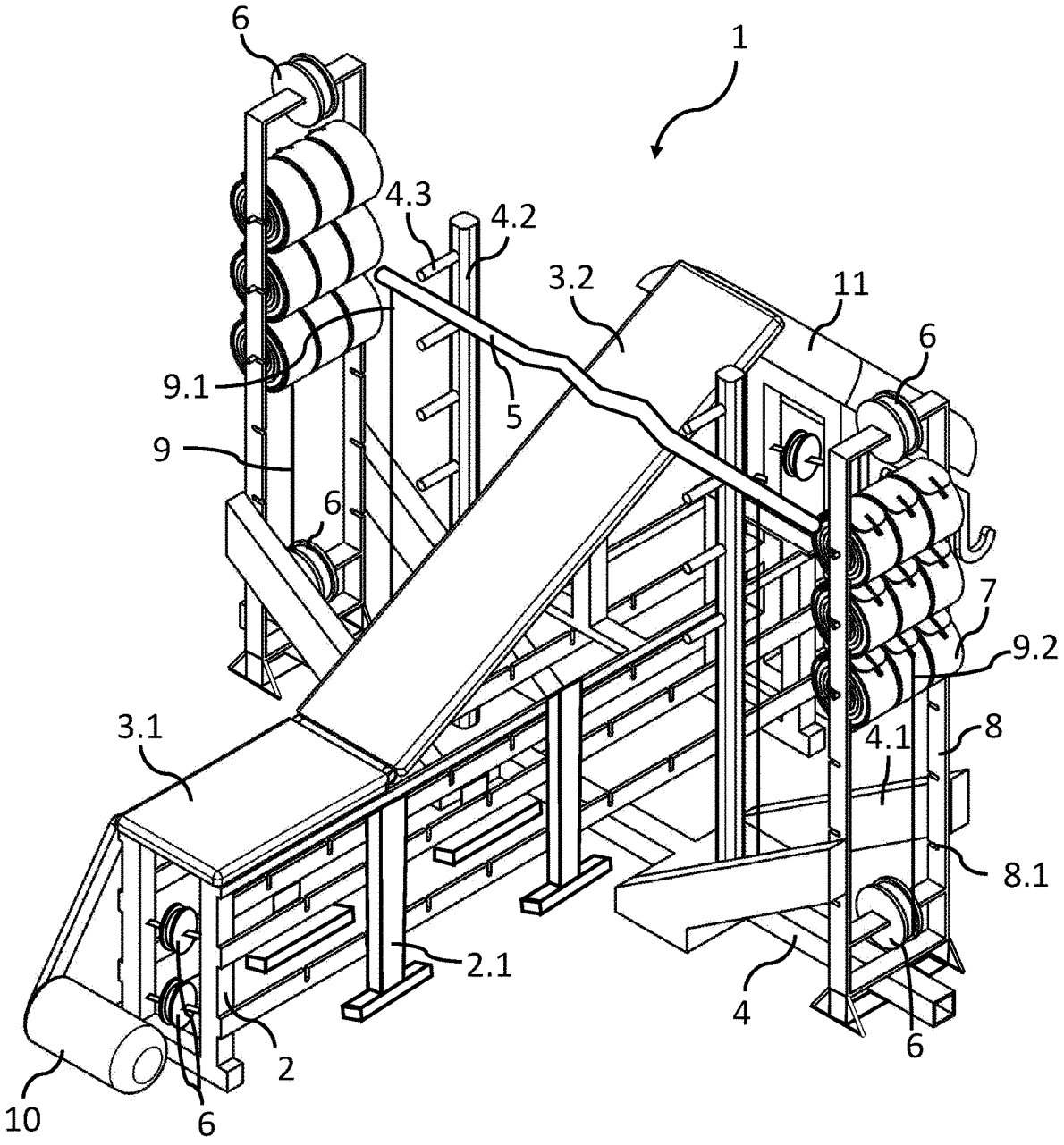
FIG. 1 is an isometric, perspective front view of a portable collapsible fitness equipment system.

Now referring to the drawings, preferred embodiments of the invention are described below. Reference throughout this specification to "one embodiment", "this embodiment" and similar phrases, means that a particular feature, structure, or characteristic described in connection with the embodiment is included in at least one embodiment. Thus, the appearances of these phrases in various places throughout this specification are not necessarily all referring to the same embodiment. Furthermore, the particular features, structures, or characteristics may be combined in any suitable manner in one or more embodiments.

Figure 7:
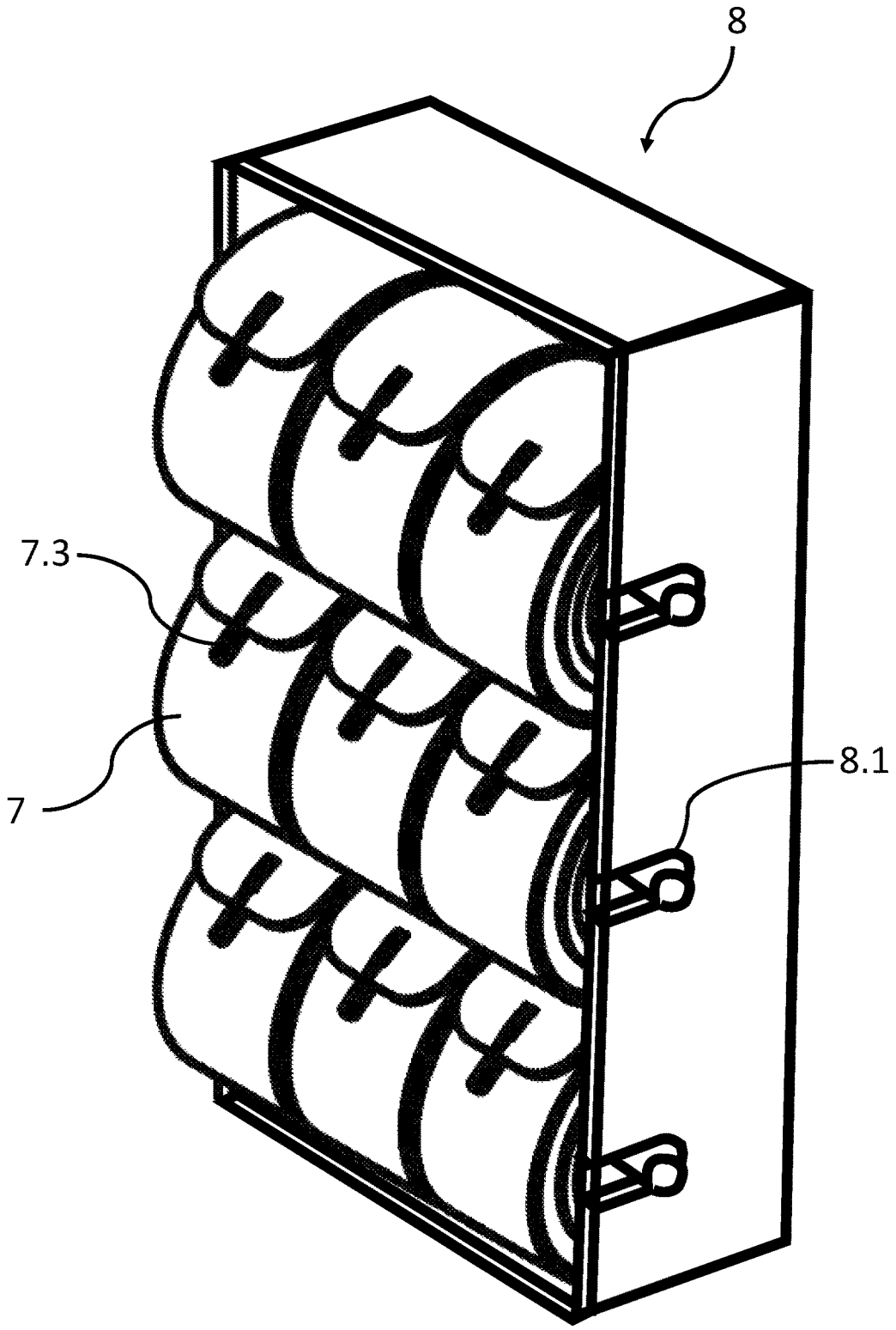
FIG. 7 is a perspective front view of secondary frame assembly visualizing the installed constant force resistance apparatus.
Figure 8:
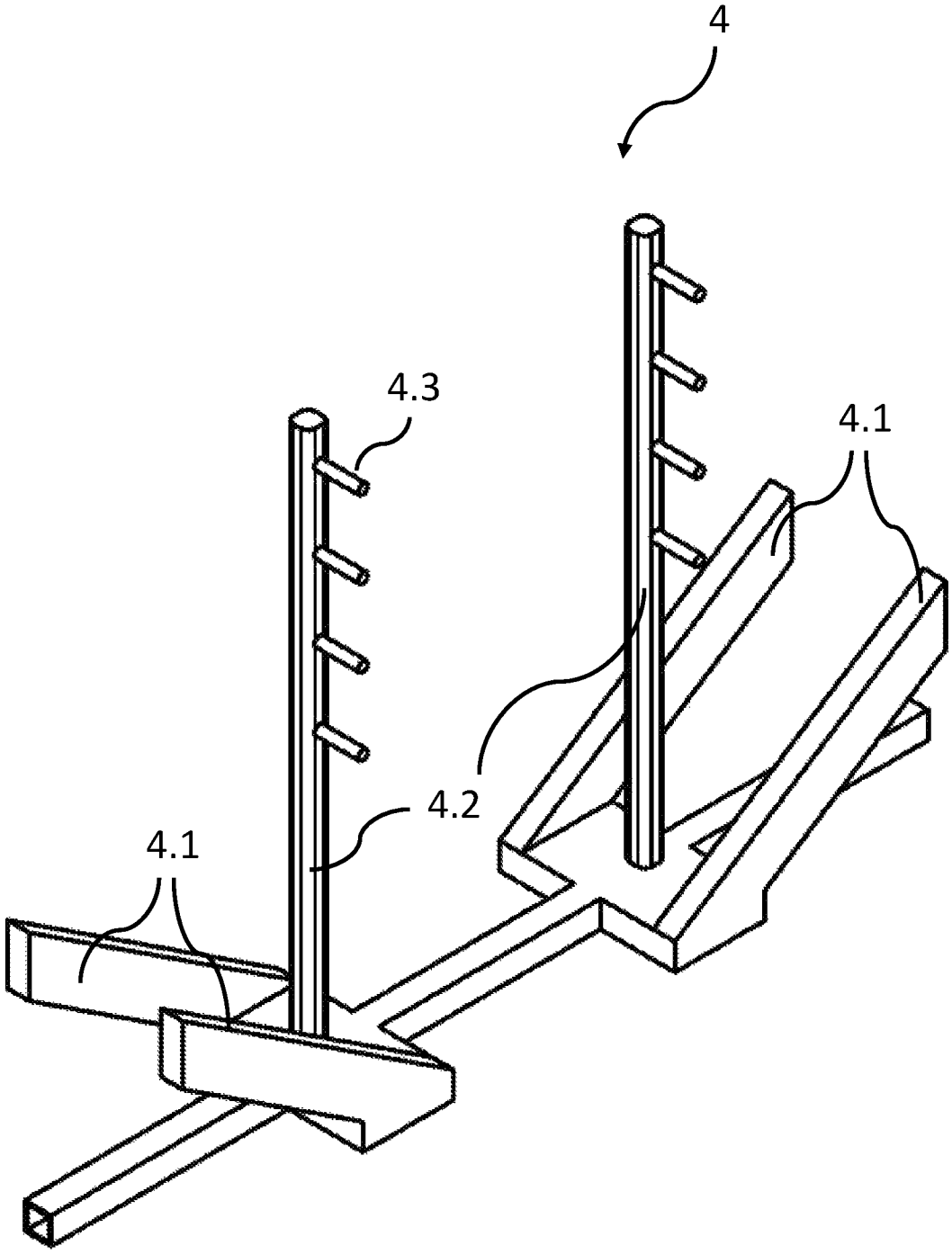
FIG. 8 is a perspective front view of base support frame assembly.

In the preferred embodiment of the present invention, the portable collapsible full body workout fitness system 1 as illustrated in FIG. 1 comprises a primary frame assembly 2, wherein said primary frame assembly 2 further comprises plurality of support means 2.1 that are attached to said primary frame assembly 2 to provide support when user performs exercises; a bench assembly 3, wherein said bench assembly 3 further comprises an adjustable seat portion 3.1 and a back-supporting portion 3.2 that are detachably attachable to said primary frame assembly 2; a base support frame assembly 4 (See FIG. 8), wherein said base support frame assembly 4 further comprises plurality of arms 4.1 diagonally extended from the horizontal base of said base support frame assembly 4, said base support frame assembly 4 further comprises at least two vertical modules 4.2 that are detachably attachable to said horizontal base of said base support frame assembly 4, said vertical modules 4.2 further comprises equidistantly arranged plurality of holder components 4.3 that are useful to hold the force apparatus 5, said base support frame assembly 4 further comprises plurality of rotatable pulleys 6 that are detachably attachable to the horizontal base of the base support frame assembly 4; at least one constant force resistance apparatus 7 (See FIGS. 2 to 4), wherein said constant force resistance apparatus 7 further comprises a constant force resistance spring module 7.1 and a supporting reel module 7.2, the exterior end of said constant force resistance spring module 7.1 further comprises a linking apparatus 7.3; a secondary frame assembly 8, wherein said secondary frame assembly 8 (See FIG. 7) further comprises plurality of slots 8.1 to enable the detachable attachment of at least one constant force resistance apparatus 7; at least one exercise cable 9 arranged in said primary 2 or secondary frame 8 and having a proximal end 9.1 and a distal end 9.2, wherein said proximal end 9.1 of the cable 9 being located outside said primary 2 or secondary frame 8 and being attached to a force apparatus 5 that enables a user to exert a tensile force to the cable 9 by pulling or pushing the cable 9 in a desired direction, said distal end 9.2 of the cable being connected to the linking apparatus 7.3 of said constant force resistance spring module 7.1; a leg support means 10; and a preacher curl bench module 11.

In the preferred embodiment of the present invention, the fastening means to detachably attach different frames, modules and apparatus of the present invention may be including but not limited to nuts and bolts, snap fit clips, traditional fasteners, and bonding clips.

Figure 2:
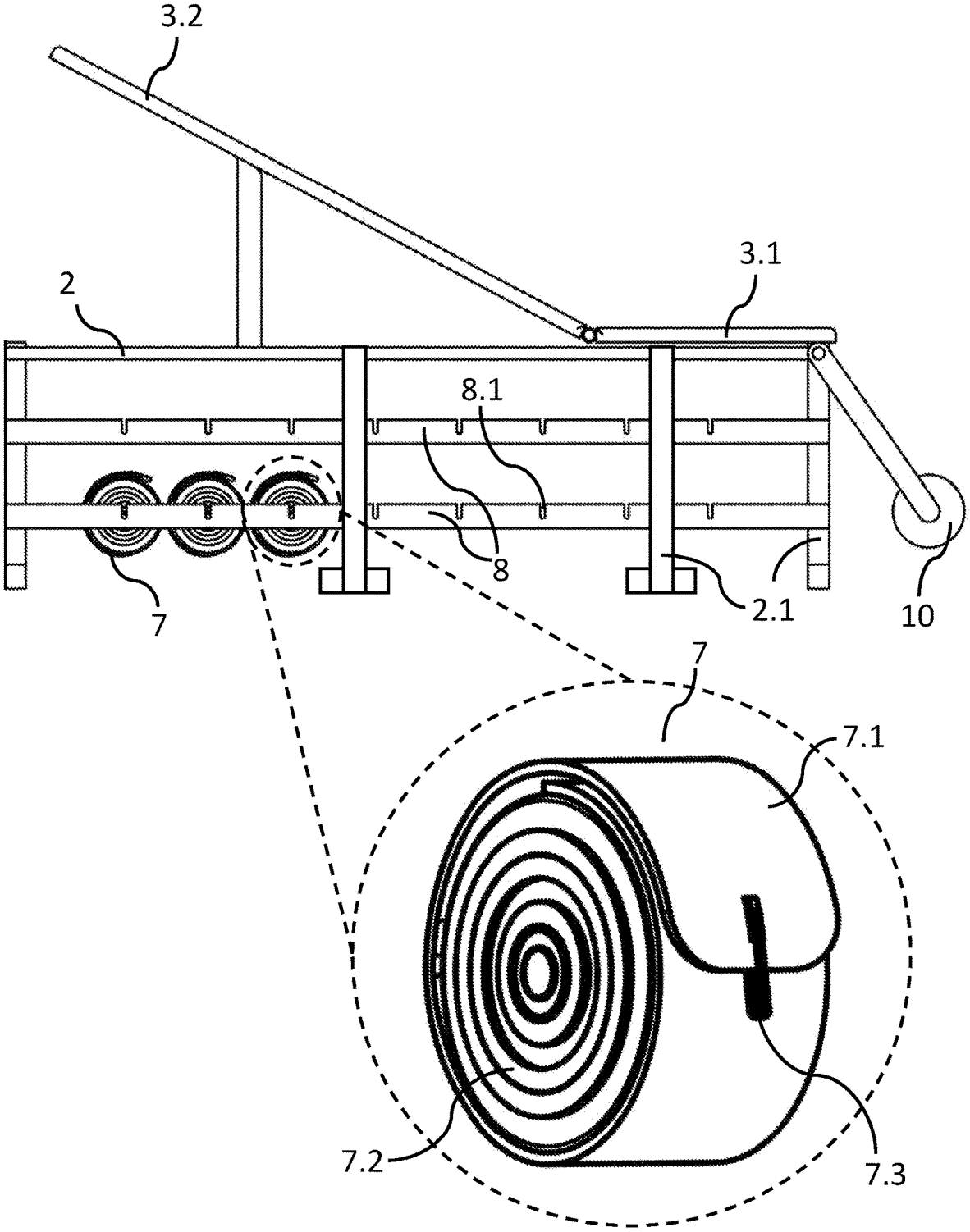
FIG. 2 is a side view of portable collapsible fitness equipment system with a focused illustration of constant force resistance apparatus.
Figure 3:
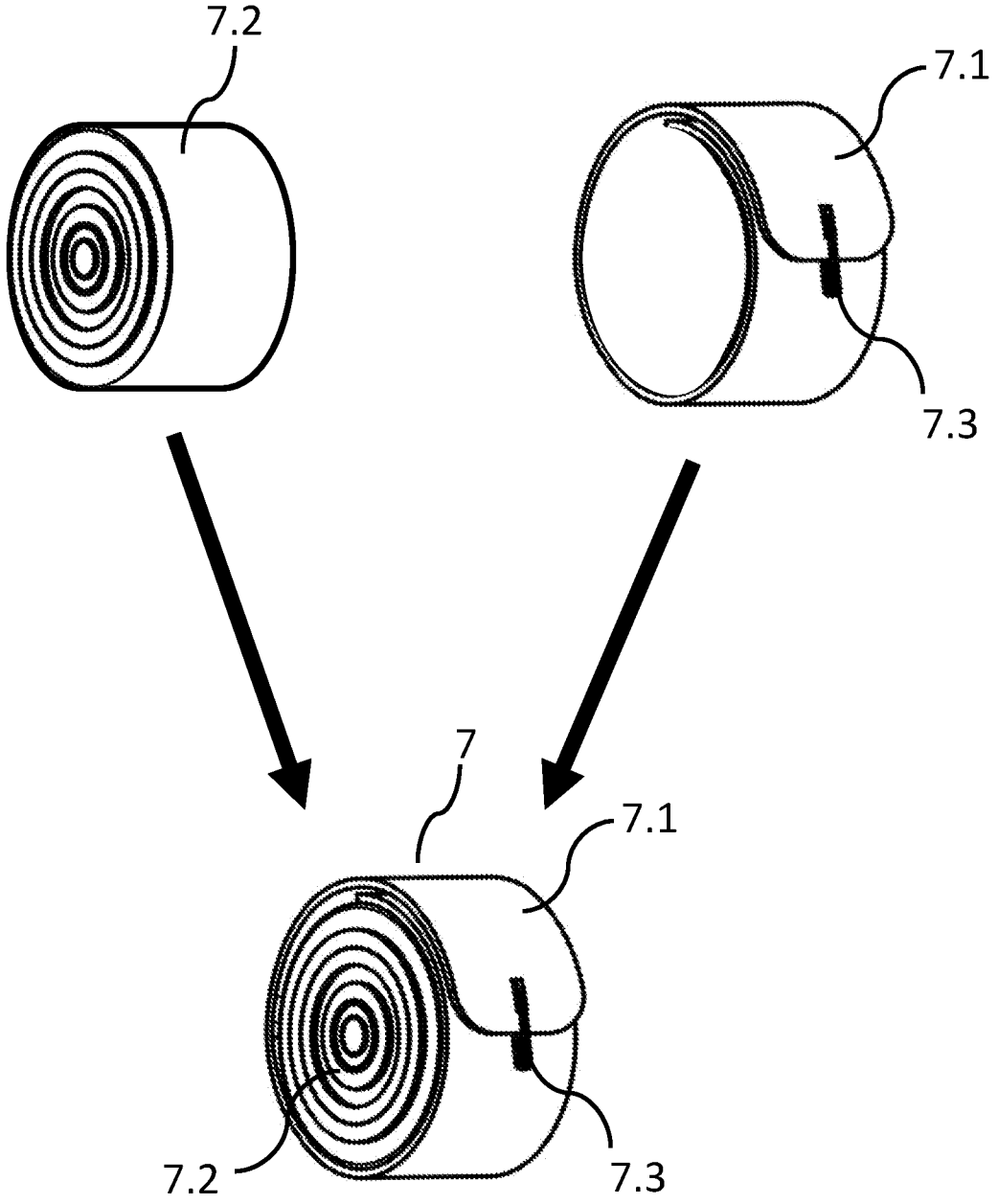
FIG. 3 is an illustration of modules of constant force resistance apparatus and their integration to form a constant force resistance apparatus.
Figure 4:
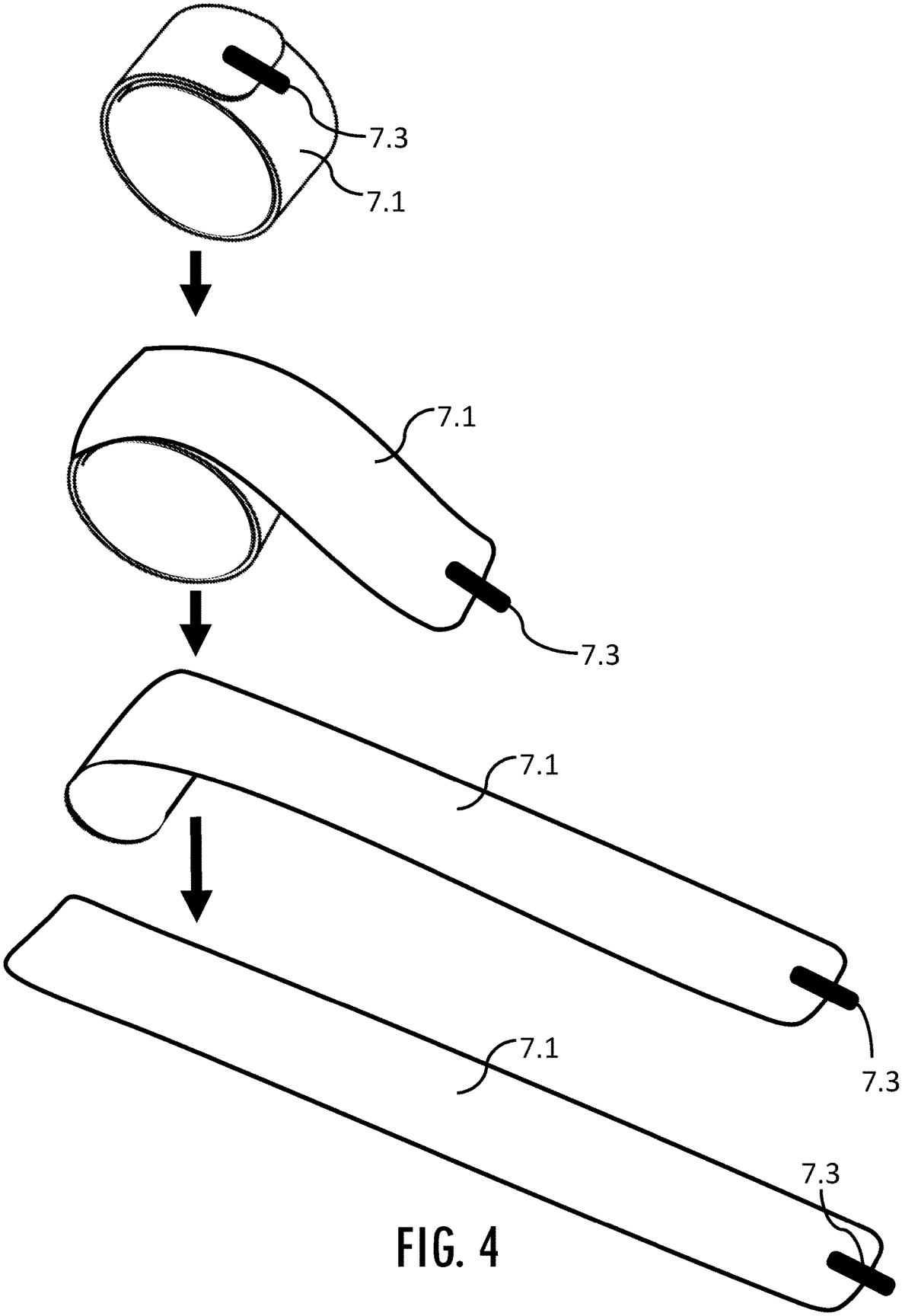
FIG. 4 is a step wise illustration of working mechanism of constant force resistance spring module.

With reference to the FIG. 2, the constant force resistance apparatus 7 may be detachably attached to the slots 8.1 provided on the secondary frame assembly 8 which may be parallelly detachably attached to the primary frame assembly 2 depending on the exercise requirement of the user. Similarly, FIG. 3 provides a visualization of two components of the constant force resistance apparatus 7 that can be combined together to form a constant force resistance apparatus 7. Specifically, the two components of the constant force resistance apparatus 7 include a constant force resistance spring module 7.1 and a reel module 7.2. Specifically, FIG. 4 provides a stepwise illustration of working mechanism of the constant force resistance spring module 7.1 when a specific force is applied on it. A constant force resistance spring module 7.1 is a roll of pre-stressed strip which exerts a nearly constant restraining force to resist uncoiling. The force is constant because the change in the radius of curvature is constant. This is true if the change in coil diameter due to buildup is disregarded.

Figure 9:
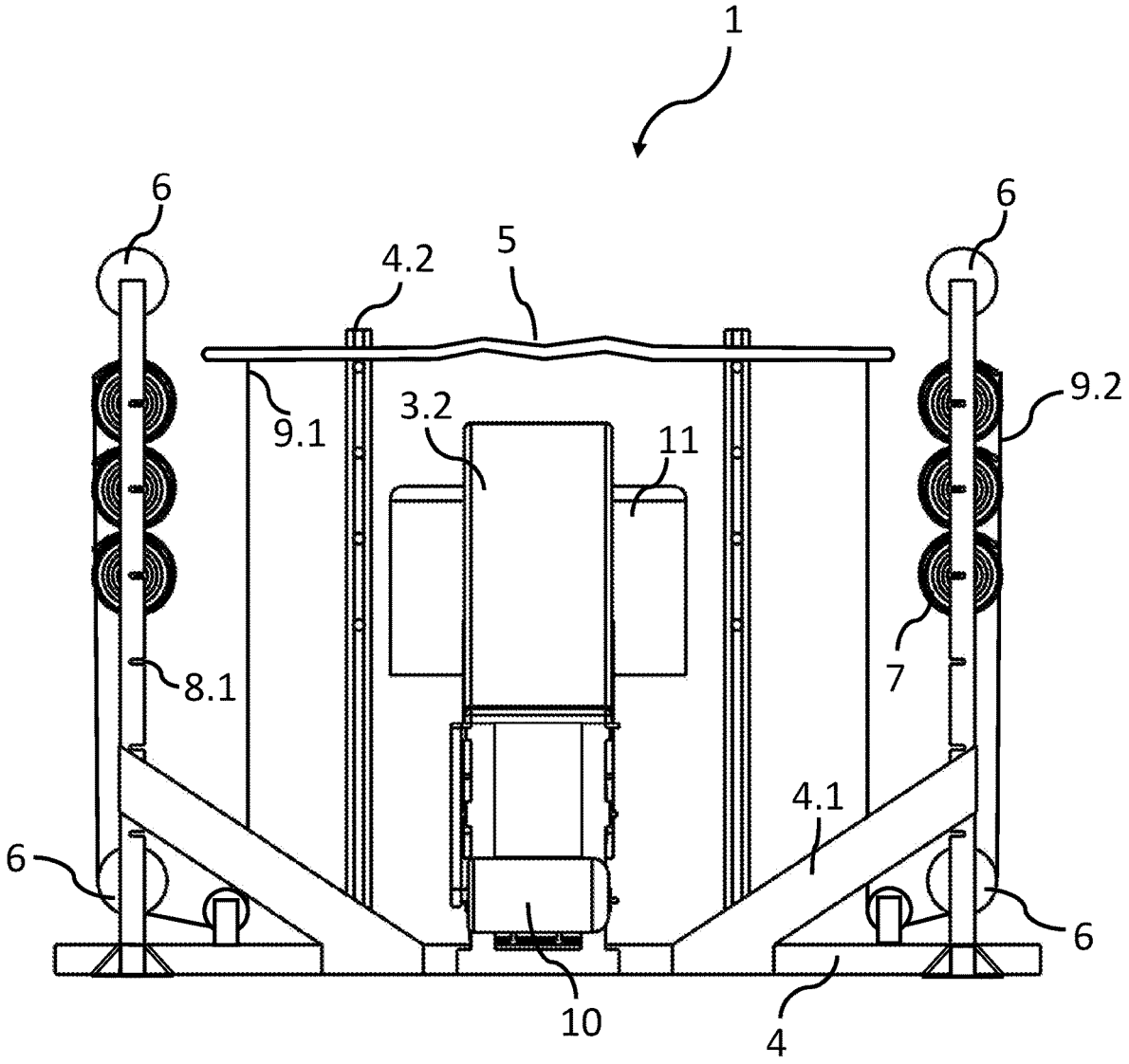
FIG. 9 is a front view of portable collapsible fitness equipment system.
Figure 10:
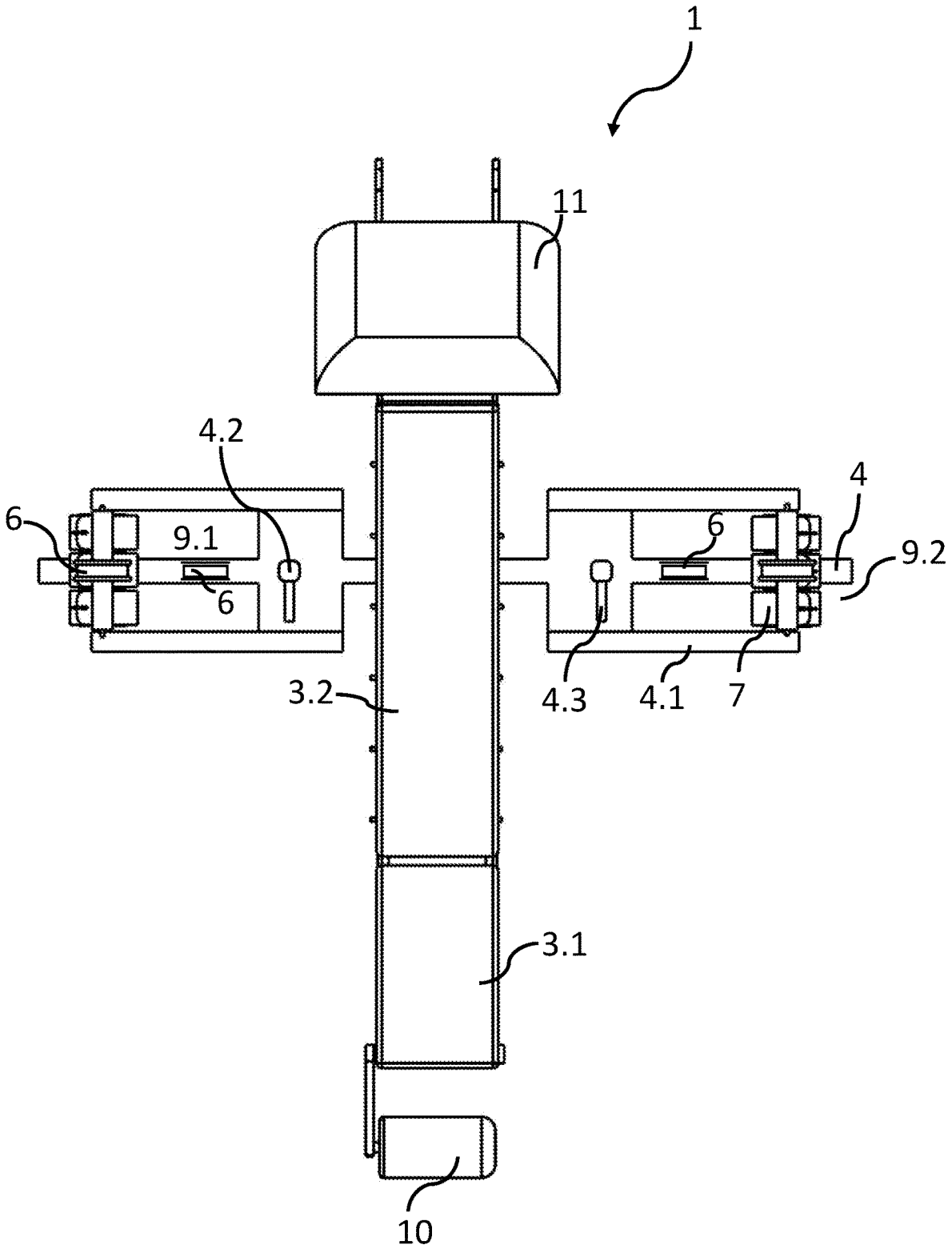
FIG. 10 is a top view of portable collapsible fitness equipment system.
Figure 11:
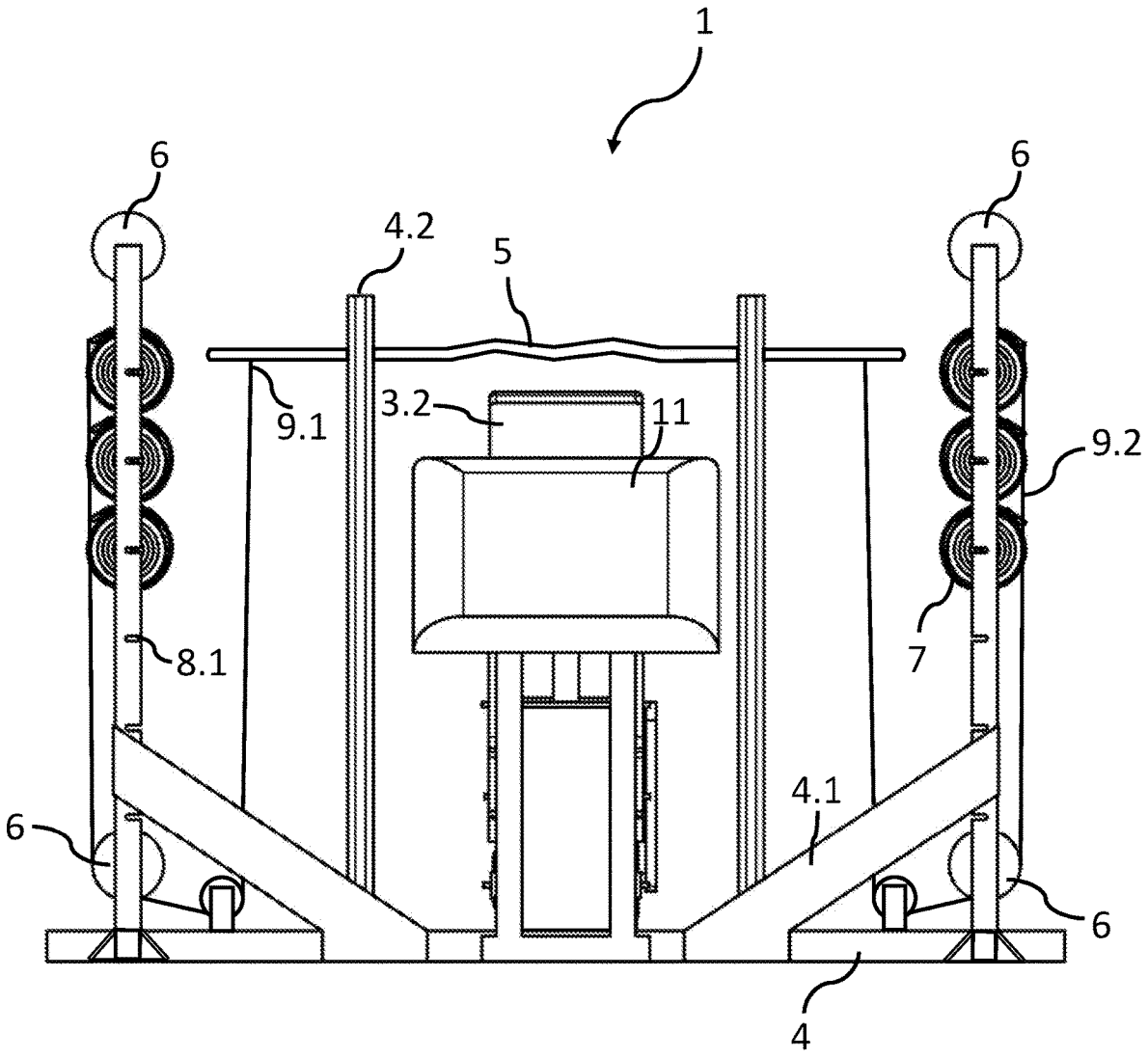
FIG. 11 is a back view of portable collapsible fitness equipment system
Figure 12:
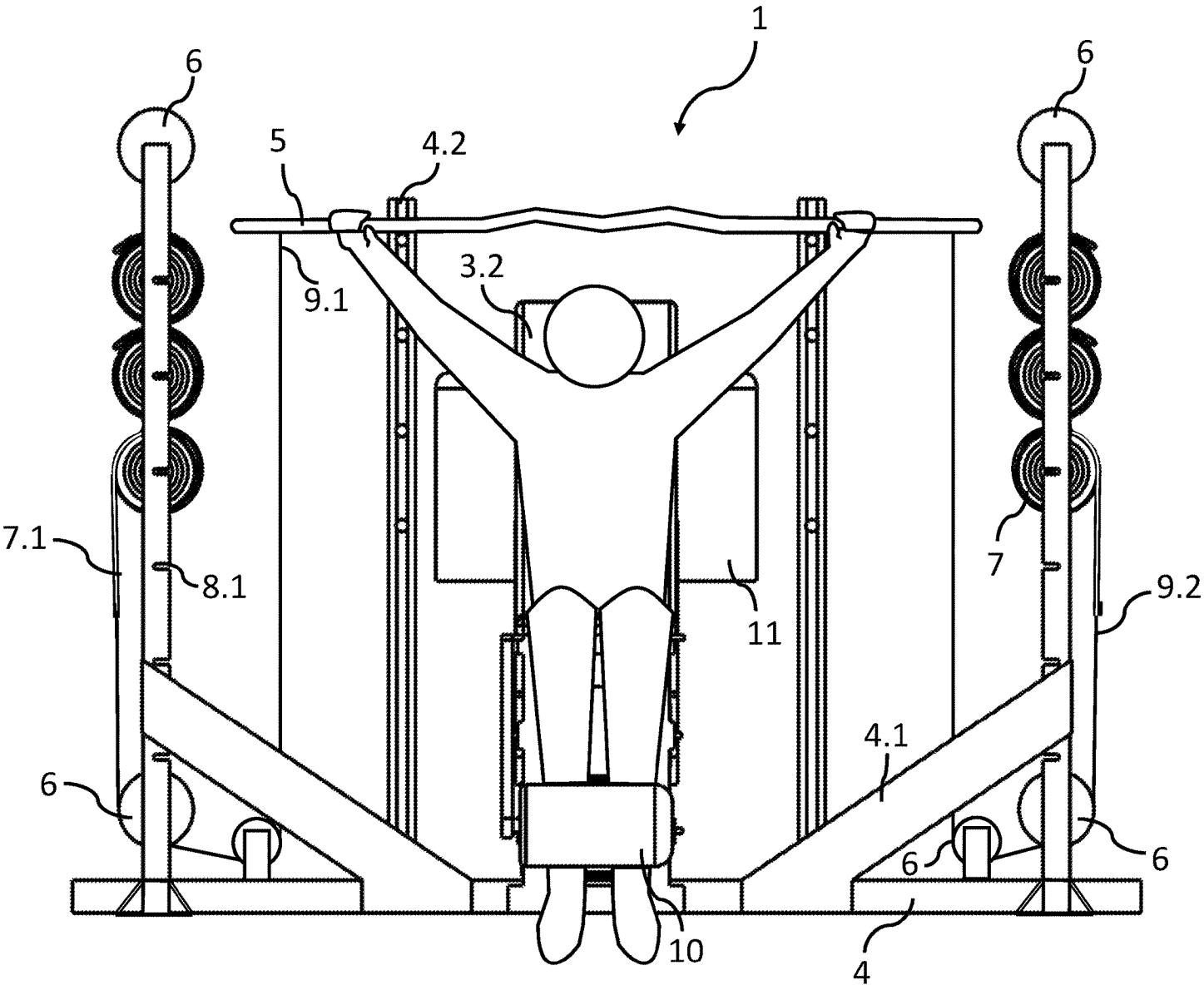
FIG. 12 is a front view of portable collapsible fitness equipment system with focused illustration of user performing an exercise.

In the preferred embodiment of the present invention as illustrated in FIGS. 9 to 11, the base support frame assembly 3 may be detachably attached to the primary frame assembly 2. Further, at least one secondary frame assembly 8 may be detachably attached to either ends of the base support frame assembly 3. In the next step, constant force resistance apparatus 7 may be installed to the slots 8.1 available on the secondary frame assembly 8. Further, the distal end 9.2 of the exercise cable 9 may be detachably attached to the linking apparatus 7.3 of at least one constant force resistance apparatus 7 and proximal end 9.1 may be detachably attached to the force apparatus 5 through the provided pulleys 6 that may be detachably attached to the base support frame assembly 3. In this particular embodiment, the force apparatus 5 may be including but not limited an exercise rod such as barbell. Additionally, FIG. 12 provides further visualization of the user performing exercise using the above the described embodiment.

Figure 5:
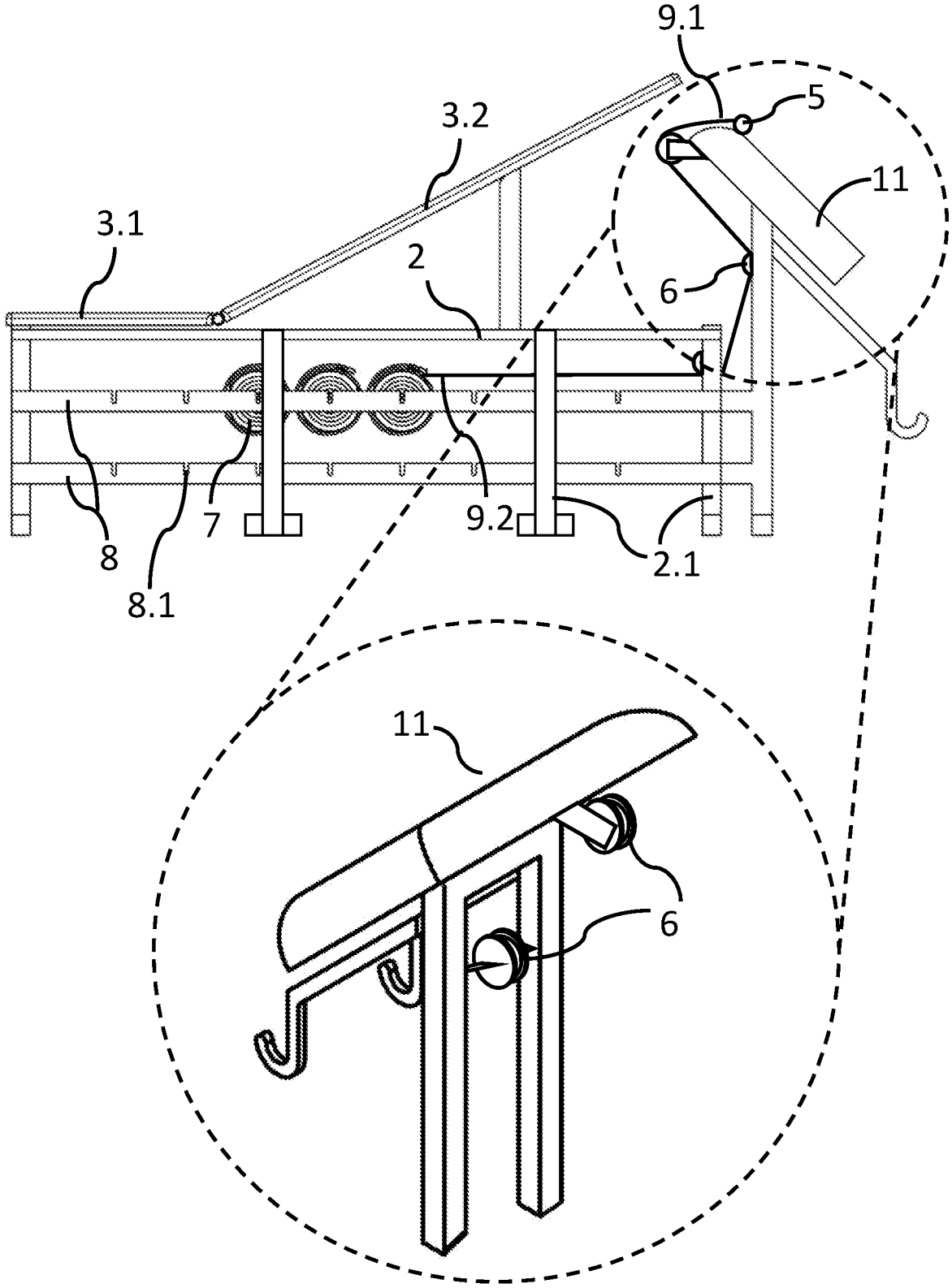
FIG. 5 is a side view of portable collapsible fitness equipment system with a focused illustration of preacher curl bench module.
Figure 14:
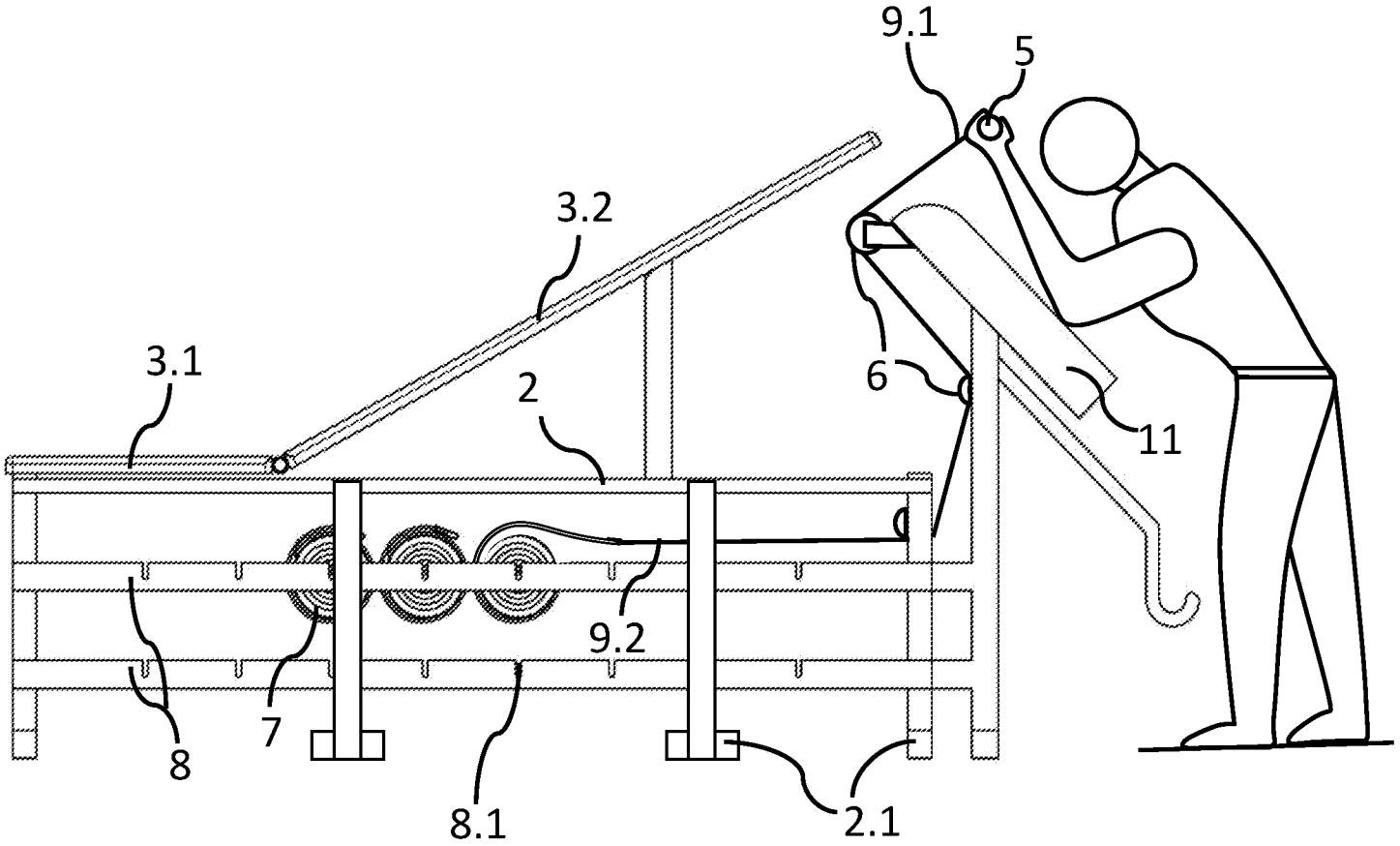
FIG. 14 is a side view of portable collapsible fitness equipment system with focused illustration of user performing an exercise using preacher curl bench module.

In another embodiment of the present invention, a preacher curl bench 11 may be detachably attached to back end of the primary frame assembly 2 as illustrated in FIG. 5. The distal end 9.2 of the exercise cable 9 may be detachably attached to the linking apparatus 7.3 of at least one constant force resistance apparatus 7 and proximal end 9.1 may detachably attached to the force apparatus 5 through the provided pulleys 6 available on the preacher curl bench 11. Additionally, FIG. 14 provides further visualization of the user performing exercise using the above the described embodiment.

Figure 6:
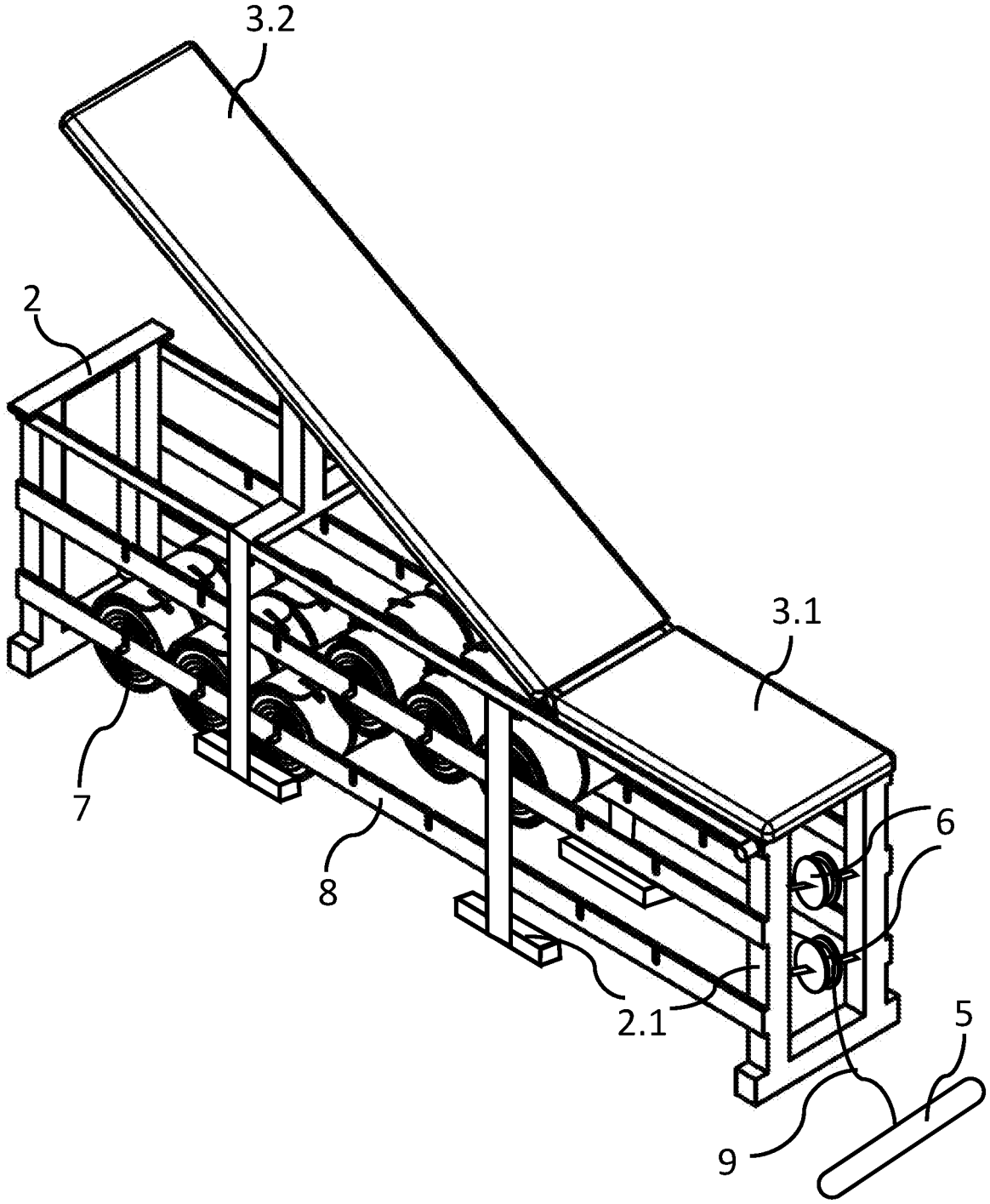
FIG. 6 is perspective front view of a preferred embodiment portable collapsible fitness equipment system.
Figure 13:
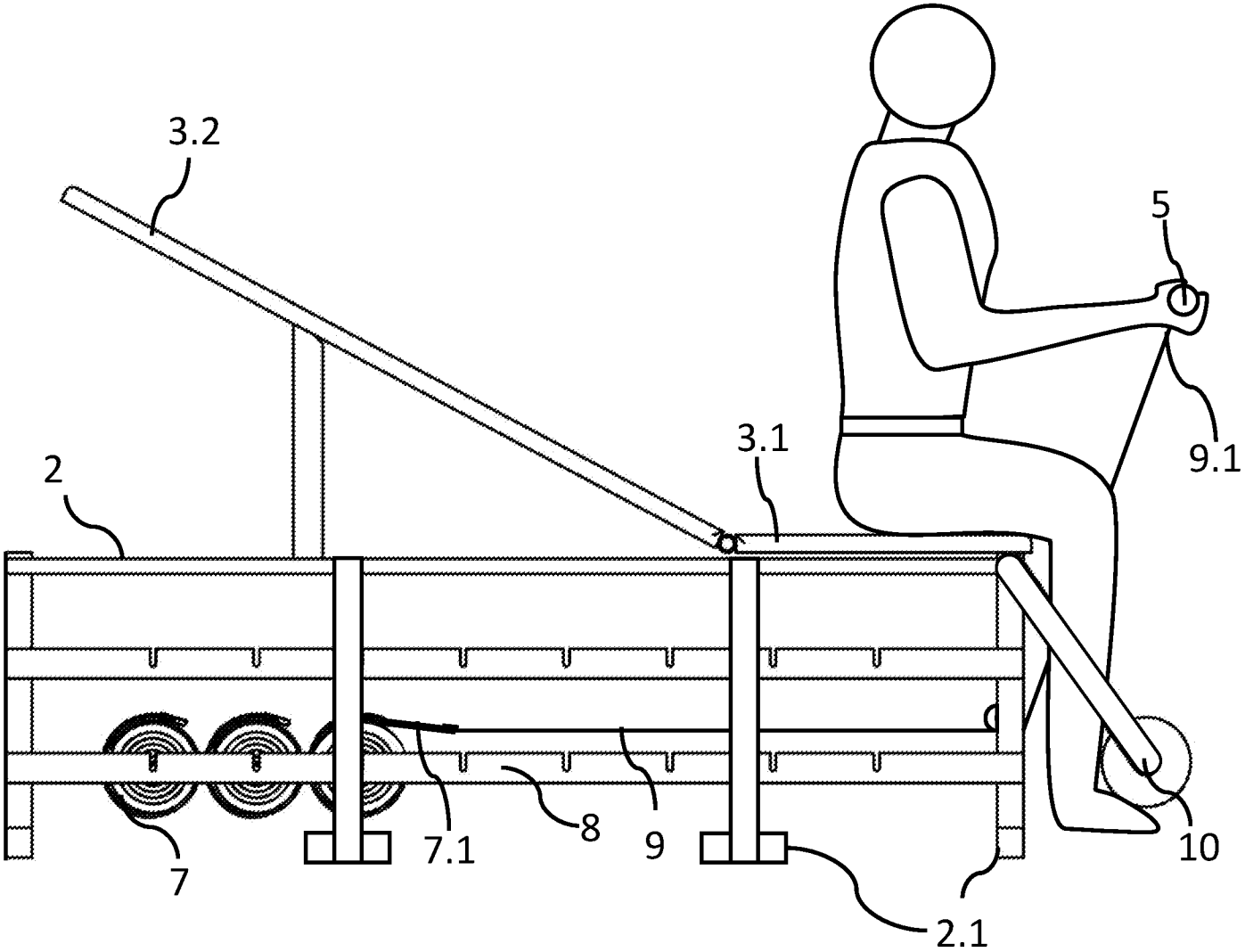
FIG. 13 is a side view of portable collapsible fitness equipment system with focused illustration of user performing an exercise.

In a further preferred embodiment of the present invention as visualized in FIG. 6 and FIG. 13, the distal end 9.2 of the exercise cable 9 may be detachably attached to the linking apparatus 7.3 of at least one constant force resistance apparatus 7 and proximal end 9.1 may detachably attached to the force apparatus 5 through the provided pulleys 6 that may be detachably attached to the front end of the primary frame assembly 2. Additionally, FIG. 13 provides further visualization of the user performing exercise using the above the described embodiment.

I claim:

1. A portable collapsible fitness equipment system comprising:

a) a primary frame assembly, wherein said primary frame assembly further comprises a plurality of supports that are attached to said primary frame assembly and configured to provide support when a user performs exercises;

b) a bench assembly, wherein said bench assembly further comprises an adjustable seat portion and a back-supporting portion that are detachably attachable to said primary frame assembly;

c) a base support frame assembly, wherein said base support frame assembly further comprises a plurality of arms diagonally extended from a horizontal base of said base support frame assembly, said base support frame assembly further comprises at least two vertical modules that are detachably attachable to said horizontal base of said base support frame assembly, each of said at least two vertical modules further comprises an equidistantly arranged plurality of holder components that are configured to hold an exercise barbell, said base support frame assembly further comprising a plurality of rotatable pulleys that are detachably attachable to the horizontal base of the base support frame assembly;

d) at least one constant force resistance apparatus, wherein said at least one constant force resistance apparatus further comprises a constant force resistance spring module and a supporting reel module, an exterior end of said constant force resistance spring module further comprises a linking apparatus;

e) a secondary frame assembly, wherein said secondary frame assembly further comprises a plurality of slots to enable detachable attachment of the at least one constant force resistance apparatus;

f) at least one exercise cable arranged in said primary or secondary frame assembly and having a proximal end and a distal end, wherein said proximal end of the at least one exercise cable being located outside said primary or secondary frame assembly and being attached to a gripping device configured to enable the user to exert a tensile force to the at least one exercise cable by pulling or pushing the at least one exercise cable in a desired direction, said distal end of the at least one exercise cable being connected to the linking apparatus of said constant force resistance spring module;

g) a leg support; and h) a preacher curl bench module.

2. The portable collapsible fitness equipment system of claim 1, wherein: said secondary frame assembly is configured to be vertically detachably attachable to the base support frame assembly or horizontally detachably attachable to the primary frame assembly depending on the type of exercise performed by the user.

3. The portable collapsible fitness equipment system of claim 1, wherein: said constant force resistance spring module of said at least one constant force resistance apparatus is configured to exert a near constant force.

4. The portable collapsible fitness equipment system of claim 1, wherein: said at least one constant force resistance apparatus is configured to be detachably attachable to said secondary frame assembly depending on the type of exercise performed by the user.

5. The portable collapsible fitness equipment system of claim 1, wherein: said secondary frame assembly is configured to be detachably attachable to the primary frame assembly depending on the type of exercise performed by the user.

6. The portable collapsible fitness equipment system of claim 1, wherein: said secondary frame assembly is configured to be detachably attachable to said plurality of arms and said horizontal base of said base support frame assembly depending on the type of exercise performed by the user.

7. The portable collapsible fitness equipment system of claim 1, wherein: said leg support is detachably attachable to a front end of said primary frame assembly.

8. The portable collapsible fitness equipment system of claim 1, wherein: said preacher curl bench module is detachably attachable to a back end of said primary frame assembly.

9. The portable collapsible fitness equipment system of claim 1, wherein: said preacher curl bench module is height adjustable.

10. The portable collapsible fitness equipment system of claim 1, wherein: said at least one constant force resistance apparatus comprises a plurality of constant force resistance apparatuses configured to provide different levels of resistance from very low resistance to very high resistance depending on the requirement of the user.

11. The portable collapsible fitness equipment system of claim 1, wherein: said constant force resistance springs module is configured to be completely uncoiled to form of a flat sheet.

12. A method of providing constant force resistance through a range of motion for exercising using the portable collapsible fitness equipment system of claim 1, comprising the steps of:

a) installing said at least one constant force resistance apparatus to said secondary frame assembly;

b) detachably attaching said at least one exercise cable having said proximal and distal ends, wherein said distal end of said at least one exercise cable is detachably attachable to the linking apparatus of said at least one constant force resistance apparatus installed on said secondary frame assembly and said proximal end of said at least one exercise cable is detachably attachable through said plurality of rotatable pulleys to said gripping device;

c) applying force on said gripping device through a range of motion;

d) displacing the exterior end of the constant force resistance spring module, where said exterior end is connected to the linking apparatus; and e) producing constant force by uncoiling the constant force resistance spring module.

13. A method of installing the portable collapsible fitness equipment system of claim 1, comprising the steps of:

a) attaching the bench assembly assembly to an upper horizontal part of said primary frame assembly;

b) detachably attaching the leg support to a front end of said primary frame assembly;

c) detachably attaching the preacher curl bench module to a back end of said primary frame assembly;

d) attaching said base support frame assembly perpendicularly to said primary frame assembly;

e) detachably attaching said secondary frame assembly vertically said base support frame assembly;

f) installing said at least one constant force resistance apparatus to said secondary frame assembly;

g) detachably attaching at least one of said plurality of rotatable pulleys to a lower part of said secondary frame assembly and at least one of said plurality of rotatable pulleys to each end of the base support frame assembly;

h) detachably attaching said at least one exercise cable having said proximal and distal ends, wherein said distal end of said at least one exercise cable is detachably attached to the linking apparatus of said at least one constant force resistance apparatus installed on said secondary frame assembly and said proximal end of said at least one exercise cable is detachably attached through the pulleys to one end of the exercise barbell located on the holder components of the base support frame assembly.

* * * * *